US008813413B2

(12) United States Patent
Howe et al.

(10) Patent No.: US 8,813,413 B2
(45) Date of Patent: Aug. 26, 2014

(54) WEAPON SIGHT LIGHT EMISSION MEMBER LOCKING SYSTEM

(71) Applicants: Phillip D. Howe, Fort Collins, CO (US); Richard A. Moore, Fort Collins, CO (US); Richard K. Herndon, Fort Collins, CO (US)

(72) Inventors: Phillip D. Howe, Fort Collins, CO (US); Richard A. Moore, Fort Collins, CO (US); Richard K. Herndon, Fort Collins, CO (US)

(73) Assignee: North Pass, Ltd., Fort Collins, CO (US)

( * ) Notice: Subject to any disclaimer, the term of this patent is extended or adjusted under 35 U.S.C. 154(b) by 191 days.

(21) Appl. No.: 13/659,615

(22) Filed: Oct. 24, 2012

(65) Prior Publication Data

US 2014/0109460 A1 Apr. 24, 2014

(51) Int. Cl.

| | |
|---|---|
| ***F41G 1/00*** | (2006.01) |
| ***F41G 1/34*** | (2006.01) |
| ***F41G 1/08*** | (2006.01) |

(52) U.S. Cl.

CPC . *F41G 1/345* (2013.01); *F41G 1/08* (2013.01)
USPC ..... 42/132

(58) Field of Classification Search

USPC ..... 42/111, 132, 144, 145; 33/263, 265, 33/266

See application file for complete search history.

(56) References Cited

U.S. PATENT DOCUMENTS

| | | | | |
|---|---|---|---|---|
| 898,531 | A | | 9/1908 | Tults |
| 1,292,211 | A | | 1/1919 | Young |
| 1,346,303 | A | | 7/1920 | Trevor et al. |
| 2,610,405 | A | * | 9/1952 | Dickinson ..... 42/143 |
| 2,706,335 | A | | 4/1955 | Munsey |
| 2,970,380 | A | | 2/1961 | Hill |
| 3,098,303 | A | | 7/1963 | Plisk |
| 3,362,074 | A | | 1/1968 | Luebkeman et al. |
| 3,678,590 | A | | 7/1972 | Hayward |
| 3,698,092 | A | | 10/1972 | Rosenhan |
| 3,886,667 | A | | 6/1975 | Rueb |
| 3,949,482 | A | * | 4/1976 | Ross ..... 42/120 |
| 4,070,763 | A | | 1/1978 | Carts, Jr. |
| 4,136,963 | A | | 1/1979 | Budden et al. |
| 4,536,965 | A | | 8/1985 | Tildeblad |
| 4,745,686 | A | | 5/1988 | Willis |
| 4,745,698 | A | | 5/1988 | Schwulst |
| 4,806,007 | A | | 2/1989 | Bindon |
| 4,877,324 | A | | 10/1989 | Hauri et al. |
| 5,065,519 | A | | 11/1991 | Bindon |

(Continued)

FOREIGN PATENT DOCUMENTS

| | | |
|---|---|---|
| AT | 507403 A1 | 4/2010 |
| CH | 667150 A5 | 9/1988 |

(Continued)

OTHER PUBLICATIONS

U.S. Appl. No. 61/459,749, filed Dec. 17, 2010.

(Continued)

*Primary Examiner* — Gabriel Klein
(74) *Attorney, Agent, or Firm* — Craig R. Miles; CR Miles, P.C.

(57) ABSTRACT

An aiming sight having a sight body having a bore communicating between first and second body ends adapted to receive within in unflexed retained engagement a light conductive member configured to receive light along the length and conduct the light to at least one light conductive member end to provide a viewable aiming indicia.

21 Claims, 8 Drawing Sheets

(56) References Cited

U.S. PATENT DOCUMENTS

| | | | | |
|---|---|---|---|---|
| 5,279,061 | A | 1/1994 | Betz et al. | |
| 5,359,800 | A | 11/1994 | Fisher | |
| 5,404,667 | A * | 4/1995 | Schmitter | 42/111 |
| 5,560,113 | A | 10/1996 | Simo et al. | |
| 5,638,604 | A | 6/1997 | Lorocco | |
| 5,735,070 | A | 4/1998 | Vasquez et al. | |
| 5,822,872 | A | 10/1998 | Waki | |
| 5,836,100 | A * | 11/1998 | Stover | 42/132 |
| 5,850,700 | A | 12/1998 | Capson et al. | |
| 5,862,618 | A | 1/1999 | Brown | |
| 5,878,503 | A | 3/1999 | Howe et al. | |
| 5,926,963 | A | 7/1999 | Knight | |
| 5,930,906 | A | 8/1999 | Howe et al. | |
| 5,956,854 | A | 9/1999 | Lorocco | |
| 6,014,830 | A | 1/2000 | Brown et al. | |
| 6,035,539 | A | 3/2000 | Hollenbach et al. | |
| 6,058,615 | A | 5/2000 | Uhlmann et al. | |
| 6,058,616 | A | 5/2000 | Bubits | |
| 6,122,833 | A | 9/2000 | Lorocco | |
| 6,216,352 | B1 | 4/2001 | Lorocco | |
| 6,233,836 | B1 | 5/2001 | Uhlmann | |
| 6,358,855 | B1 | 3/2002 | Ramachandran et al. | |
| 6,360,471 | B1 | 3/2002 | Stein | |
| 6,360,472 | B1 | 3/2002 | Lorocco | |
| 6,385,855 | B1 | 5/2002 | Tymianski | |
| 6,421,946 | B1 | 7/2002 | LoRocco | |
| 6,446,377 | B1 | 9/2002 | Hollenbach et al. | |
| 6,678,987 | B2 | 1/2004 | Howe | |
| 6,684,551 | B2 | 2/2004 | Howe | |
| 7,562,486 | B2 | 7/2009 | LoRocco | |
| 2006/0123687 | A1 | 6/2006 | Howe et al. | |
| 2008/0184609 | A1 | 8/2008 | Schulst | |
| 2009/0013581 | A1 | 1/2009 | LoRocco | |
| 2011/0107650 | A1 * | 5/2011 | Howe et al. | 42/132 |
| 2012/0151817 | A1 | 6/2012 | Howe et al. | |

FOREIGN PATENT DOCUMENTS

| | | | |
|---|---|---|---|
| EP | 0254675 | A | 1/1988 |
| GB | 1532090 | A | 11/1978 |
| WO | WO2006/111813 | A1 | 10/2006 |
| WO | WO2010/034458 | A1 | 4/2010 |
| WO | WO2011/067291 | A1 | 6/2011 |

OTHER PUBLICATIONS

U.S. Appl. No. 13/134,524, filed Jun. 8, 2011.

* cited by examiner

CONVENTIONAL ART

WEAPON SIGHT LIGHT EMISSION MEMBER LOCKING SYSTEM

I. BACKGROUND

An aiming sight having a sight body having a bore communicating between first and second body ends adapted to receive within in unflexed retained engagement a light conductive member configured to receive light along the length and conduct the light to at least one light conductive member end to provide a viewable aiming indicia Certain conventional aiming sights use light gathering elements such as optical fiber(s), fluorescent fibers, or the like, to transmit ambient light to one or both ends to provide a viewable aiming indicia useful in aiming an aimed device. The light gathering elements may be held within a sight body adapted to mount to the aimed device.

While a variety of conventional aiming sights including one or more light gathering elements are known a variety of long felt but unresolved problems remain unresolved. A first substantial problem with conventional aiming sights can be that the light gathering element is coupled in fixed relation in the sight body and cannot be removed for replacement with another light gathering element.

Another substantial problem with conventional aiming sights can be that the light gathering element structured in fixed relation in the sight body migrates due to failure in whole or in part of the attachment means holding the light gathering structure in the sight body, such as failure of adhesives or fasteners.

Another substantial problem may be that the light gathering element has at one or both end portions defects in the external surface, such pits, cavities, scratches, or the like or may have inclusions in the element ends such as bubbles, all of which can be caused by forming the ends portions under heat. As one example, the sight body can provide a pair of annular rings spaced a distance apart. The light gathering element can be passed through the corresponding annular ring apertures. The end portions of the light gathering element may then be heated and urged toward the corresponding annular rings to enlarge the end portions to an extent that prevents either end from passing through the annular ring apertures, thereby retaining the light gathering element in the sight body. Heating can cause inclusions to form in the end portions and pressure applied to the external surface may cause surface defects. Additionally, heat formed end portions can more readily break away from the light gathering element.

Another substantial problem with conventional aiming sights can be that the light gathering element fails due to the structure of the light gathering element or due to the structure of the attachment means or the interaction of the light gathering element with the attachment means. As shown in the example of FIG. 1, certain conventional light gathering elements (1) have enlarged end portions (2) formed under heat and pressure, as above described. The annular rings (3) can provide annular ring apertures (5) configured to allow one or both of the enlarged end portions (2) to pass through the annular ring apertures (4). To prevent migration of the light gathering element (1) from the sight body (5), a medial portion (6) of the sight body (5) can configured to medially engage the external surface (7) of the light gathering element (1) to forcibly urge the external surface (7) of the light gathering element (1) against one or more annular rings (3) with sufficient force to retain the light gathering element (1) in fixed relation to the annular rings (3). However, sufficient forcible engagement of the sight body (5) with the external surface (7) of the light gathering element (1) can result in retained flexure (8) of the light gathering element (1) in the sight body (5). The retained flexure (8) of the light gathering element (1) can over time cause defects (9) in the light gathering element (1) such a crazing of the external surface (7) or fractures extending from the external surface (7) into the light gathering element (1) and as above described the enlarged end portions (2) can break away from the light gathering element (1).

The instant invention provides an aiming sight which overcomes in whole or in part certain of the forgoing disadvantages of conventional aiming sights,

II. SUMMARY OF THE INVENTION

Accordingly, a broad object of the invention can be to provide an aiming sight having a sight body adapted to receive in unflexed retained engagement a light conductive member configured to receive light along said length and conduct the light to at least one light conductive member end to provide a viewable aiming indicia.

Another substantial object of the invention can be an aiming sight including a light conductive member having a length disposed between a member first end and a member second end, the light conductive member having a retention recess disposed in the external surface at a location between the first member end and the second member end, and to provide a sight body adapted to mount on an aimed device, the sight body having a bore which defines a passage which communicates between a body first end and a body second end, the bore having a bore retention member which projects into the passage, the bore having a bore recess disposed in opposed relation to said retention member, the light conductive member insertingly received inside of the passage sufficiently flexes into said bore recess in response to sliding engagement of said retention member over the external surface to allow the retention recess to matedly engage the retention member, whereby the light conductive member has unflexed retained engagement within the sight body.

Naturally, further objects of the invention are disclosed throughout other areas of the specification, drawings, photographs, and claims.

III. A BRIEF DESCRIPTION OF THE DRAWINGS

Figure 1:
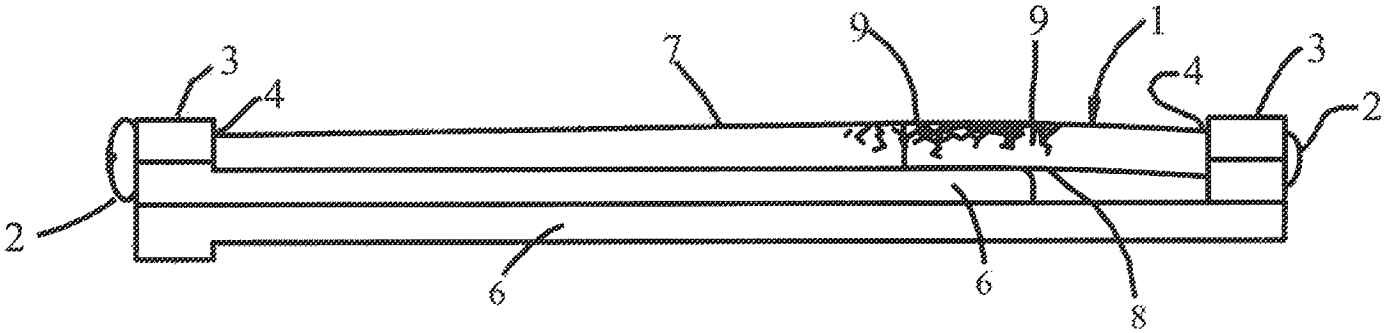
FIG. 1 is an illustration which provides an example of the conventional art.
Figure 2:
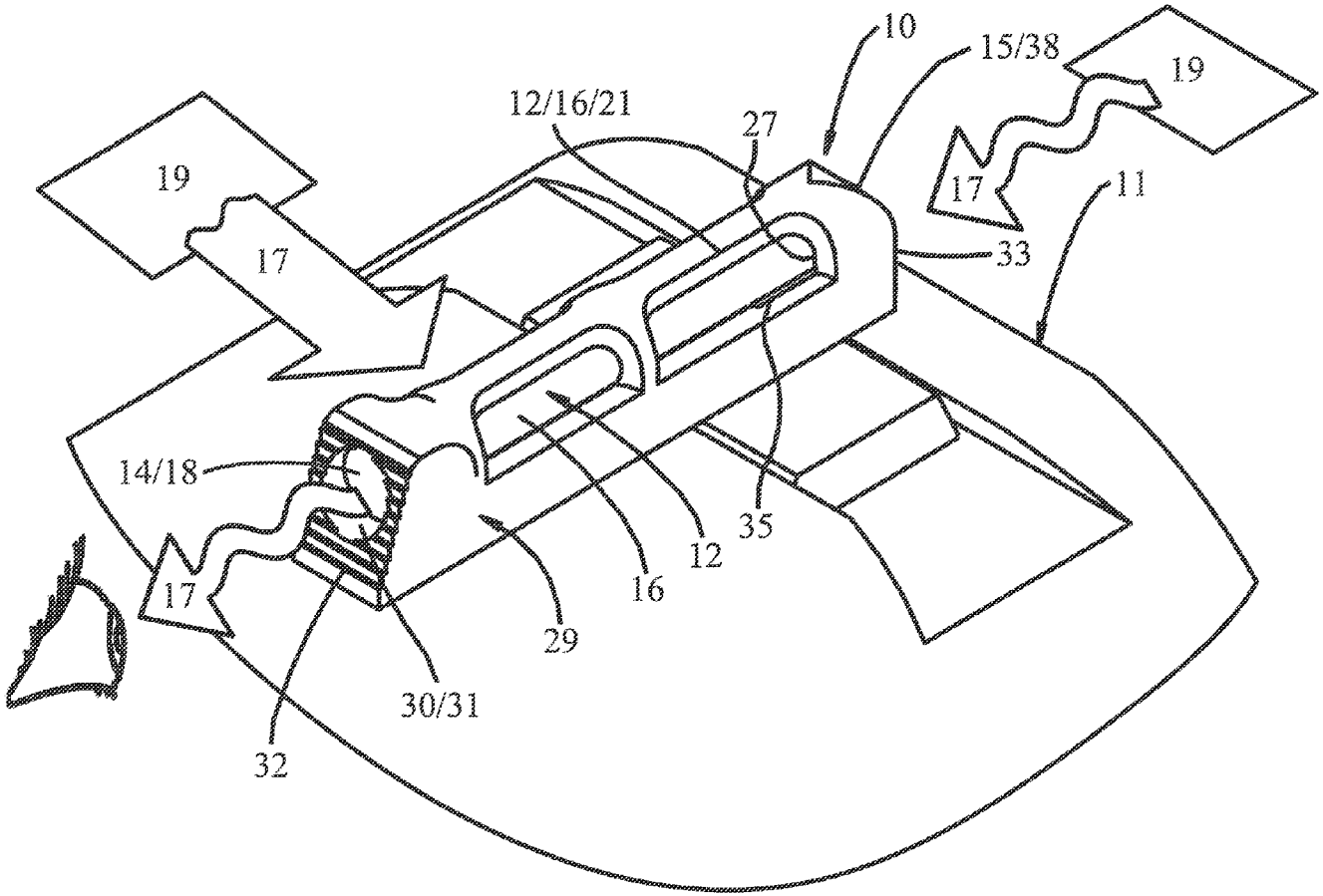
FIG. 2 is a perspective front view of an embodiment of the inventive aiming sight for an aimed device.
Figure 4:
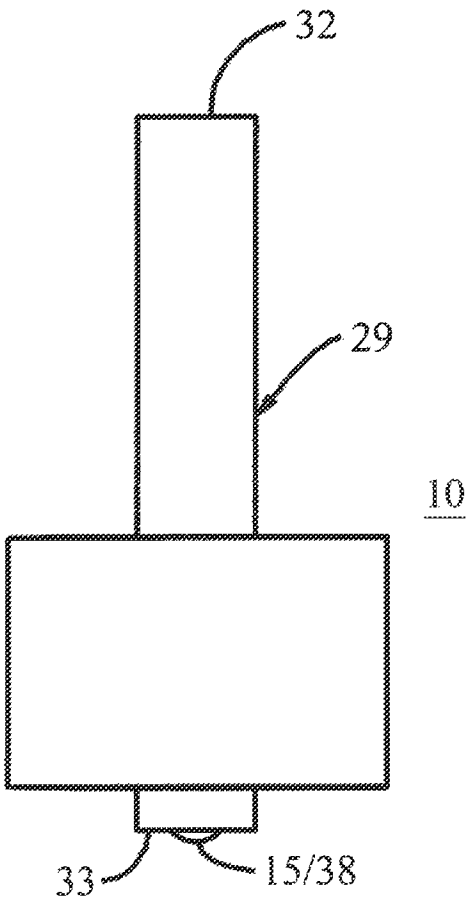
FIG. 4 is a bottom view of a particular embodiment of the inventive aiming sight.
Figure 3:
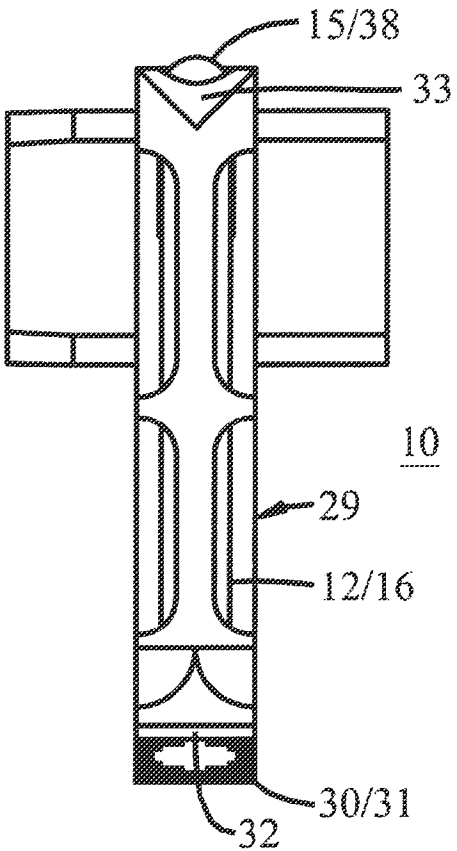
FIG. 3 is a top view of a particular embodiment of the inventive aiming sight.
Figure 6:
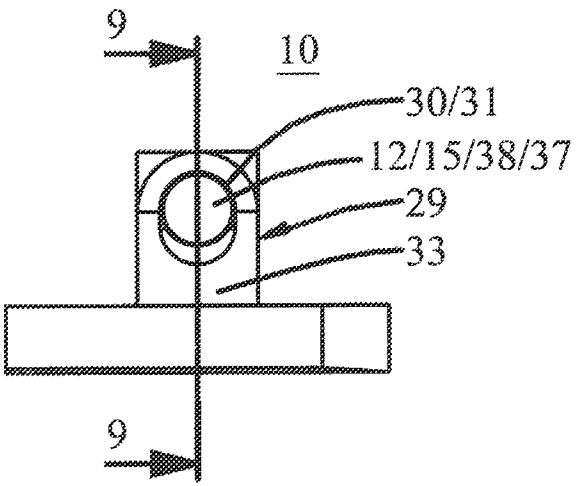
FIG. 6 is a second end view of a particular embodiment of the inventive aiming sight.
Figure 5:
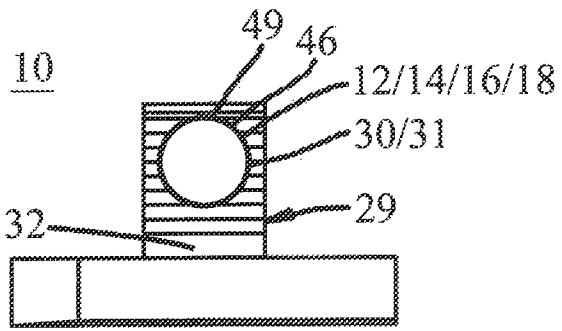
FIG. 5 is a first end view of a particular embodiment of the inventive aiming sight.
Figure 7:
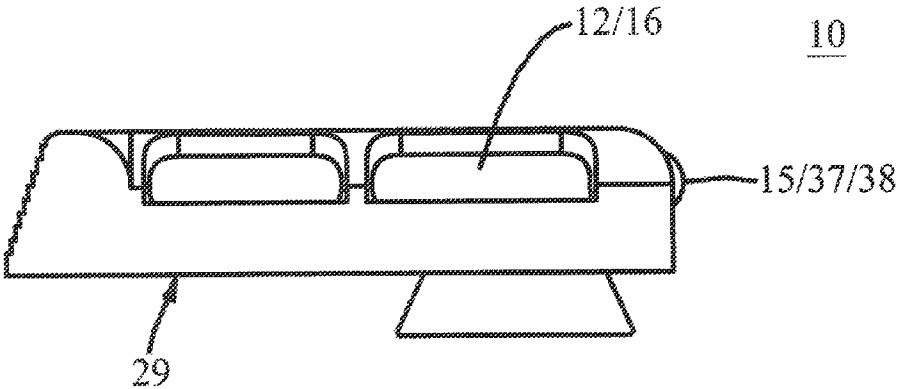
FIG. 7 is a first side view of a particular embodiment of the inventive aiming sight.
Figure 8:
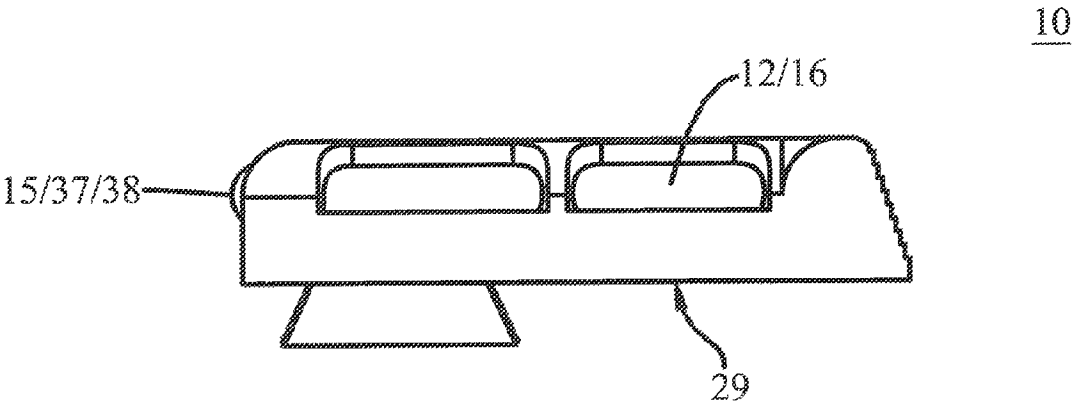
FIG. 8 is a second side view of a particular embodiment of the inventive aiming sight.
Figure 12:
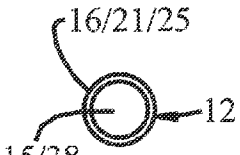

FIG. 12 a second end view of a particular embodiment of a light conductive member utilized in the particular embodiment of the inventive aiming sight shown in FIG. 2.

Figure 13:
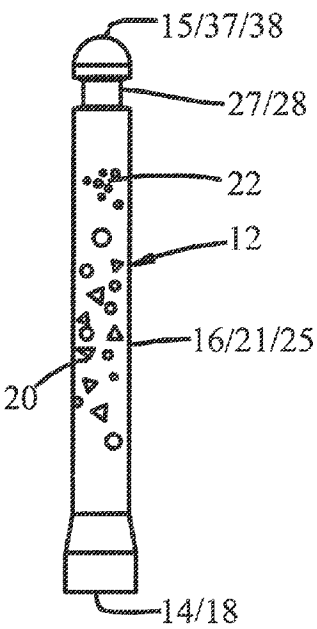
Figure 11:
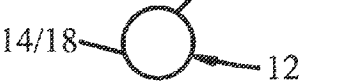
FIG. 11 is a first end view of a particular embodiment of a light conductive member utilized in the particular embodiment of the inventive aiming sight shown in FIG. 2.

FIG. 13 a top view of a particular embodiment of a light conductive member utilized in the particular embodiment of the inventive aiming sight shown in FIG. 2.

Figure 14:
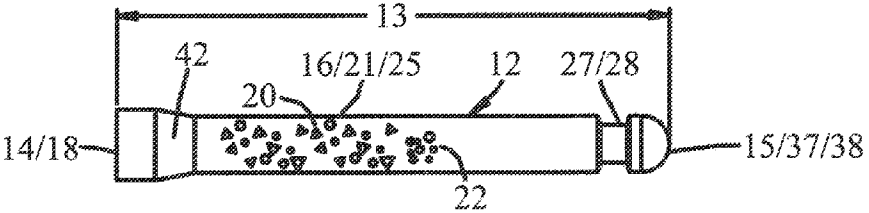

FIG. 14 a first side view of a particular embodiment of a light conductive member utilized in the particular embodiment of the inventive aiming sight shown in FIG. 2.

Figure 15:
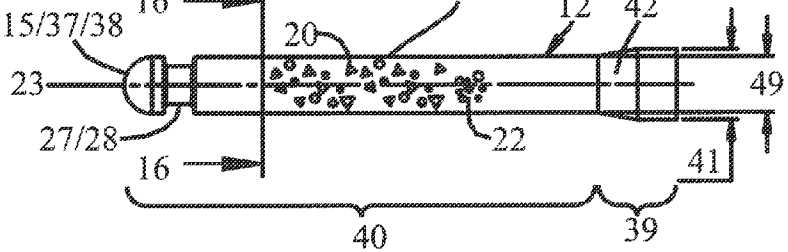

FIG. 15 a second side view of a particular embodiment of a light conductive member utilized in the particular embodiment of the inventive aiming sight shown in FIG. 2.

Figure 16:
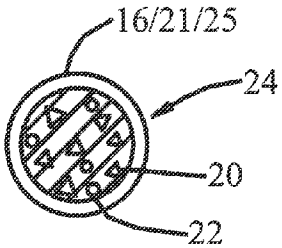

FIG. 16 is cross section view 16-16 of the particular embodiment of a light conductive member shown in FIG. 15.

IV. DETAILED DESCRIPTION OF THE PREFERRED EMBODIMENTS

Now referring primarily to FIG. 2, which shows a particular embodiment of an inventive aiming sight (10) which may be adapted for use with a numerous and wide variety of aimed devices (11) which direct energy, project beams, launch projectiles such as bullets, pellets, BBs, balls arrows, or the like, whether individually or in various combinations (individually or collectively "projectile(s)"). The aimed devices (11) to which the inventive aiming sight (10) can be adapted include, without limitation, hand guns, rifles, bows, shot guns, BB guns, pellet guns, laser weapons, energy weapons, or the like; however, these examples are not meant to be limiting, rather the term "aimed device" broadly encompasses any device which can be aimed for military, sporting, hobby or other applications.

Now referring primarily to FIGS. 11 through 16, embodiments of the inventive aiming sight (10) generally include a light conductive member (12) having a length (13) disposed between a member first end (14) and a member second end (15). The light conductive member (12) can have an external surface (16) configured to receive light (17) along the length (13) and conduct the light (17) to at least the member first end (14) to provide a viewable aiming indicia (18).

The term "light conductive member (12)" as used herein includes constructional forms of one or more light conductive materials fabricated, formed, extruded, cast, molded, or by other process(es) provides a configuration having an external surface (16) which receives an amount of light (17) in the visible, ultraviolet, or infrared spectrum, separately or in combinations thereof, from a light source (19) (or combination of light sources) external to the light conductive member (12). The light conductive member (12) can transmit the light (17) internally, in whole or in part, or as modified by one or more dopants (20) included in the light conductive material (21) of the light conductive member (12), to be emitted at one or both of the member first end (14) and the member second end (15). Various light conductive materials (21) can be utilized to produce the light conductive member (12), including, as examples: extruded, molded, cast, or fabricated plastic (such as polystyrene, polycarbonate, polyvinylchloride, TEFLON, nylon, polystyrene, polyurethane, acrylic, polyethylene terphthalate, polyethersulfone, polymethylmethacrylate, or the like, separately or in various combinations thereof. Light conductive materials (21) suitable for use in embodiments of the invention can be obtained from ACI Plastics, St. Louis, Mo., USA.

The light conductive materials (21) of embodiments of the light conductive members (12) can further include or contain one or more dopants (20). The term dopant (20) as used herein means one or a plurality of similar or dissimilar trace impurity element(s) included separately or in various permutations and combinations in the light conductive material (21) at concentrations such that the light (17) in the spectrum received by the external surface (16) and transmitted within the light conducting member (12), whether in whole or in part, activates the one or more dopant(s) (20) which in turn fluoresce in a corresponding one or more wavelengths delivered to the member first end (14) or the member second end (15) to provide a viewable aiming indicia (18).

The light conductive materials (21) of embodiment of the light conductive members (12) can further include or contain one or more colorants (22). Colorants (22) can be combined in various permutations and combinations with the light conductive material (21) and one or more dopants (20) to achieve a desired color and fluorescence of the light conductive member (12). Combinations of colorant(s) (22) with dopant(s) (20) suitable for use with embodiments of the invention can be obtained from ColorChem International Corporation, 8601 Dunwoody Place, Atlanta, Ga.; Keystone Aniline Corporation, 2501 West Fulton Street, Chicago, Ill.; or Sun Chemical Corporation, 25 Waterview Boulevard, Persippany, N.J.

Figure 9:
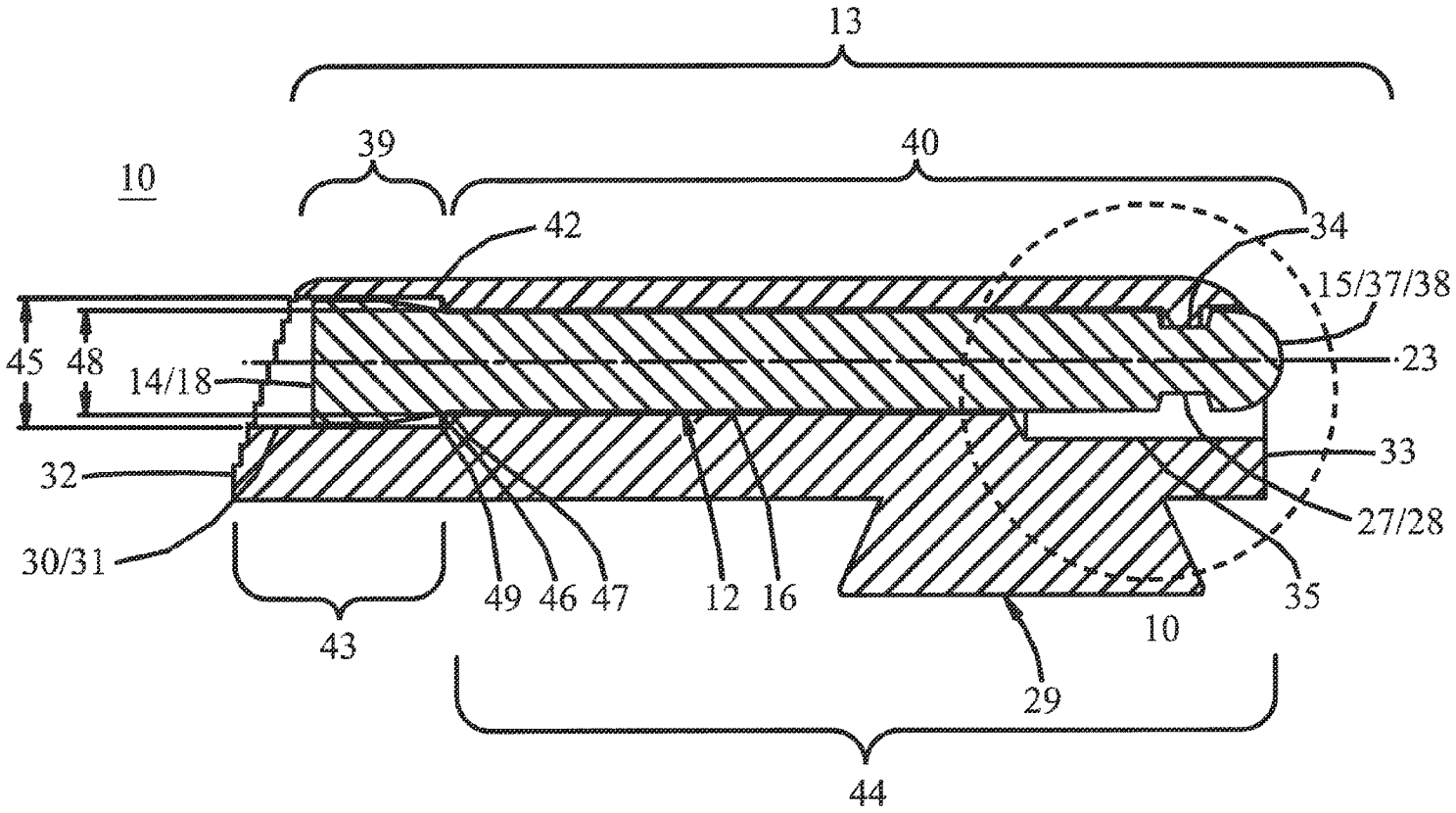
FIG. 9 is a longitudinal cross section 9-9 shown in FIG. 6.

Again referring to FIGS. 11-15, embodiments of the light conductive member (12) have a longitudinal axis (23) which passes through the member first end (14) and the member second end (15) (as shown in the example of FIG. 9) and a latitudinal cross section (24) in substantially perpendicular relation (shown as cross section 16-16 in FIG. 15). While the exemplary embodiment of the light conductive member (12) shown in the Figures is generally cylindrical (25) with a circular cross section (26), embodiments of the light conductive member (12) can have a latitudinal cross section (24) of the light conductive member (12) selected from the group including or consisting of a circular cross section, a rectangular cross section, a square cross section, an triangular cross section, and an oval cross section.

Now referring primarily to FIGS. 13 through 15, embodiments of the light conductive member (12) have a retention recess (27) disposed in the external surface (16) at a location between the first member end (14) and the second member end (15). As to those embodiments which are generally cylindrical (25) with a generally circular cross section (26), the retention recess (27) can be in the form of an annular groove (28) which can be located proximate the member second end (15); however, it is not intended that the example of FIGS. 13 through 15 be limiting with respect to the wide variety of external surface (16) configurations and corresponding configurations of retention recesses (27) which be used with embodiments of the invention.

Now referring primarily to FIGS. 3 through 8, embodiments of the invention further include a sight body (29) adapted to mount on an aimed device (11), as above described. The sight body (29) can have a bore (30) which defines a passage (31) which communicates between a body first end (32) and a body second end (33), the passage (31) correspondingly configured to slidely receive the various embodiments of light conductive members (12), above described, therein. The bore (30) can have a bore retention member (34) which projects into the passage (31) and the bore (30) can further have a bore recess (35) disposed in opposed relation to the retention member (34) projecting into the passage (31) (as shown in the example of FIGS. 9 and 10).

Figure 10:
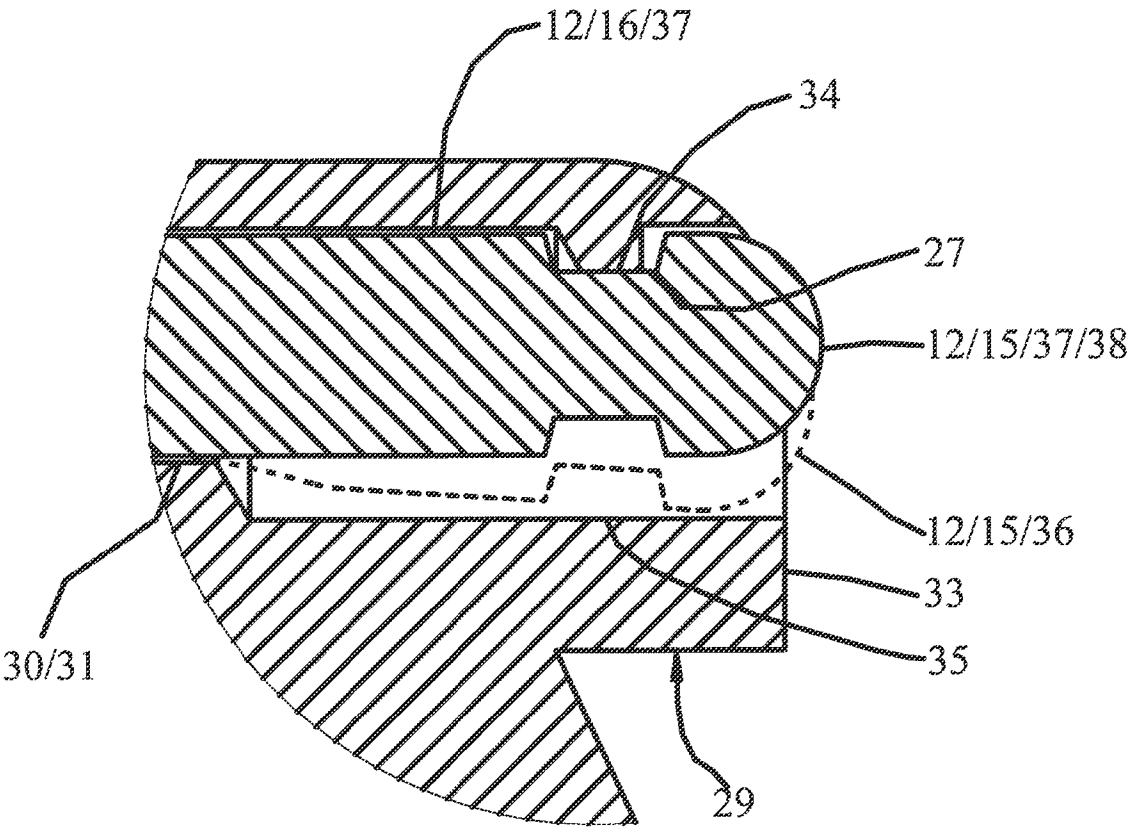
FIG. 10 is an enlarged portion of the longitudinal cross section shown in FIG. 9.

Now referring primarily to FIGS. 9 and 10, embodiments of the light conductive member (12) insertingly received inside of the passage (31) of the sight body (29) sufficiently flexes (36) into the bore recess (35) in response to sliding engagement of the bore retention member (34) over the external surface (16) of the light conductive member (12) to allow the retention recess (27) to matedly engage the retention member (34) (as shown in the example of FIG. 10). Mated engagement of the bore retention member (34) of the sight body (29) in the retention recess (27) of the light conductive member (12) interrupts axial travel of the light conductive member (12) in the sight body (29) and allows the light conductive member (12) to return to the unflexed condition and be retained unflexed (37) in the sight body (29).

There are advantages in retaining the light conductive member (12) in the sight body (29) unflexed (37). In the unflexed condition, the light conductive member (12) can be retained in the sight body (29) as a linear structure (as shown in the example of FIG. 9) which does not induce flexural strain on the light conductive member (12). Accordingly, embodiments of the light conductive member (12) are not subject to fatigue or failure in the form of crazing of the exterior surface (16) or the formation of cracks along the length (13) of the light conductive member (12), either of which can result in a reduced light (17) being transmitted to the first and second member ends (14)(15) and a reduced brightness of the viewable aiming indicia (18).

In the examples of FIGS. 9 and 10, the external surface (16) of the light conductive member (12) has a generally cylindrical (25) configuration and terminates at the member second end (15) in a hemisphere (38). As to these embodiments, the bore retention member (34) engages the external surface (16) of the member second end (15) having the form of a hemisphere (36). The bore retention member (34) slides over the external surface (16) of the hemisphere (38) generating corresponding amount of flexure in the light conductive member (12) which disposes the member second end (15) a distance into the bore recess (35) sufficient to allow the bore retention member (34) to mateably engage with the retention recess (27) of the light conductive member (12).

Now referring primarily to FIG. 9, particular embodiments of the aiming sight (10) can further include an external surface (16) of the light conducting member (12) having a member first portion (39) proximate the member first end (14) and a member second portion (40) (as shown in the examples of FIGS. 9 and 15) co-axially extending from the member first portion (39) to the member second end (15). The member first portion (39) can have a greater diameter (41) than lesser diameter (49) of the member second portion (40). As to particular embodiments, the member first portion (39) and the member second portion (40) can be joined in the form of a truncated cone (42); however, other embodiments of the invention can transition between the first member portion (39) and the second member portion (40) as abutted co-axially joined cylinders.

Correspondingly, the bore (30) in the sight body (29) can have a bore first portion (43) proximate said body first end (32) and a bore second portion (44) extending from the bore first portion (43) to said body second end (33). The bore first portion (43) can have a greater diameter (45) than the bore second portion (44). The bore first portion (43) can be co-axially joined to the bore second portion (44) at a bore annular ring (46). The annular ring aperture (47) defining the diameter (48) of the bore second portion (44) and the annular ring outer edge (49) defining the greater diameter (45) of the first bore portion (43).

Each of the first bore portion (43) and the second bore portion (44) can be configured to correspondingly receive the member first portion (39) and the member second portion (40). The external surface (16) of the member first portion (39) can have abutted engagement with the bore annular ring (46) which interrupts axial travel of the light conductive member (12) in the sight body (29) toward the body second end (33). The abutted engagement of the member first portion (39) allows for sufficient axial travel of the member second end (15) to allow mated engagement of the bore retention member (34) of the sight body (29) with the retention recess (27) of the light conductive member (12).

Now referring primarily to FIG. 2, which illustrates a method of using embodiments of the inventive aiming sight (10) for an aimed device (11) which includes obtaining a light conductive member (12) having a length (13) disposed between a member first end (14) and member second end (15), the light conductive member (12) having an external surface (16) configured to receive light (17) along the length (13) and conduct the light (17) to at least the member first end (14) to provide a viewable aiming indicia (18), the light conductive member (12) having a retention recess (27) disposed in the external surface (16) at a location between the first member end (14) and the second member end (15).

The method can further include obtaining a sight body (29) adapted to mount on the aimed device (11), the sight body having a bore (30) which defines passage (31) which communicates between a body first end (32) and a body second end (33), the bore (30) having a bore retention member (34) which projects into the passage (31), the bore (30) having a bore recess (35) disposed in opposed relation to the bore retention member (34).

The method can further include inserting the light conductive member (12) inside of the passage (31) communicating between the body first end (32) and the body second end (33) of the sight body (29) and slidely engaging the bore retention member (34) projecting into the passage (31) with the external surface (16) of the light conductive member (12) sufficiently flexing the light conductive member (12) into the bore recess (35) in response to sliding engagement of the bore retention member (34) over the external surface (16), and matedly engaging the bore retention member (34) in the retention recess (27) of the light conductive member (12), thereby retaining the light conductive member (12) unflexed (37) within the sight body (29).

The method can be reversed by sufficiently flexing the light conductive member (12) proximate the member second end (15) into the bore recess (35) of the bore (30) to disengage the bore retention member (34) from the retention recess (27) of the light conductive member (12) and sliding the bore retention member (34) over the external surface (16) of the light conductive member (12) toward the member second end (15) to disengage the retention member (35) from the external surface (16) of the light conductive member (12). By unflexing the light conductive member (12) and sliding the member second end (15) toward the body first end (32), the light conductive member (12) can be removed from the sight body (29).

As can be easily understood from the foregoing, the basic concepts of the present invention may be embodied in a variety of ways. The invention involves numerous and varied embodiments of a weapon sight light emission system which can be incorporated into a wide variety of sights for weapons.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of "a sight" should be understood to encompass disclosure of the act of "sighting"—whether explicitly discussed or not—and, conversely, were there effectively disclosure of the act of "sighting", such a disclosure should be understood to encompass disclosure of "sighting" and even a "means for sighting." Such alternative terms for each element or step are to be understood to be explicitly included in the description.

In addition, as to each term used it should be understood that unless its utilization in this application is inconsistent with such interpretation, common dictionary definitions should be understood to be included in the description for each term as contained in the Random House Webster's Unabridged Dictionary, second edition, each definition hereby incorporated by reference.

Moreover, for the purposes of the present invention, the term "a" or "an" entity refers to one or more of that entity; for example, "a light source" refers to one or more of those light sources. As such, the terms "a" or "an", "one or more" and "at least one" can be used interchangeably herein.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment.

Thus, the applicant(s) should be understood to claim at least: i) each of the weapon sight light emission devices herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

The claims set forth in this specification are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

We claim:

1. An aiming sight for an aimed device, comprising:

a) a light conductive member having a length disposed between a member first end and a member second end, said light conductive member having an external surface configured to receive light along said length and conduct said light to at least said member first end to provide a viewable aiming indicia, said light conductive member having a retention recess disposed in said external surface at a location between said first member end and said second member end; and b) a sight body adapted to mount on said aimed device, said sight body having a bore which defines a passage which communicates between a body first can and a body second end, said bore having a bore retention member which projects into said passage, said bore having a bore recess disposed in opposed relation to said retention member, said light conductive member insertingly received inside of said passage and configured to sufficiently flex into said bore recess in response to sliding engagement of said retention member over said external surface to allow said retention recess to matedly engage said retention member, said light conductive member retained unflexed within said sight body.

2. The aiming sight of claim 1, wherein said bore recess disposed in opposed relation to said bore retention member has a location proximate said base second end, and wherein said retention recess has location proximate said member second end.

3. The aiming sight of claim 2, wherein said light conductive member has a longitudinal axis which passes through said member first end and said member second end, and wherein a latitudinal cross section of said light conductive member is selected from the group consisting of a circular cross section, a rectangular cross section, a square cross section, an triangular cross section, and an oval cross section.

4. The aiming sight of claim 3, wherein said light conductive member has a cylindrical configuration with said circular cross section, and wherein said retention recess comprises an annular groove.

5. The aiming sight of claim 4, wherein said external surface of said light conductive member proximate said member second end has the form of a hemisphere.

6. The aiming sight of claim 5, wherein said external surface of said light conducting member has a member first portion proximate said member first end and a member second portion extending to said member second end, said member first portion having a greater diameter than said member second portion.

7. The aiming sight of claim 6, wherein said external surface comprises a truncated cone between said member first portion and said member second portion.

8. The aiming sight of claim 7, wherein said bore has a bore first portion proximate said body first end and a bore second portion extending from said bore first portion to said body second end, said bore first portion having a greater diameter than said bore second portion, said bore first portion co-axially joined to said bore second portion by a bore annular ring, said bore first portion receiving within said member first portion, said truncated cone of said external surface having abutted engagement with said bore annular ring.

9. A method of producing an aiming sight for an aimed device, comprising:

a) providing a light conductive member having a length disposed between a member first end and a member second end, said light conductive member having an external surface configured to receive light along said length and conduct said light to at least said member first end to provide a viewable aiming indicia, said light conductive member having a retention recess disposed in said external surface at a location between said first member end and said second member end; and b) providing a sight body adapted to mount on said aimed device, said sight body having a bore which defines passage which communicates between a body first end and a body second end, said bore having a bore retention member which projects into said passage, said bore having a bore recess disposed in opposed relation to said retention member, said light conductive member insertingly received inside of said passage and configured to sufficiently flex into said bore recess in response to sliding engagement of said retention member over said external surface to allow said retention recess to matedly engage said retention member to retain said light conductive member unflexed within said sight body.

10. The method of claim 9, further comprising disposing said bore recess in opposed relation to said bore retention member proximate said base second end, and disposing said retention recess proximate said member second end.

11. The method of claim 10, further comprising configuring said light conductive member to establish a longitudinal axis which passes through said member first end and said member second end, and configuring said external surface to provide a latitudinal cross section selected from the group consisting of a circular cross section, a rectangular cross section, a square cross section, an triangular cross section, and an oval cross section.

12. The method of claim 11, further comprising configuring said external surface of said light conductive member in a cylindrical configuration having said circular cross section, and providing said retention recess as an annular groove.

13. The method of claim 12, further comprising configuring said external surface of said light conductive member proximate said member second end as a hemisphere.

14. The method of claim 13, further comprising configuring said external surface of said light conducting member to provide a member first portion proximate said member first end and a member second portion extending from said member first portion to said member second end, said member first portion having a greater diameter than said member second portion.

15. The method of claim 14, further comprising configuring said external surface joining said member first portion and said member second portion as a truncated cone.

16. The method of claim 15, configuring said bore of said sight body to provide a bore first portion proximate said body first end and a bore second portion extending from said bore first portion to said body second end, said bore first portion having a greater diameter than said bore second portion, said bore first portion co-axially joined to said bore second portion by a bore annular ring, said bore first portion receiving within said truncated cone in abutted engagement with said bore annular ring.

17. An method of using an aiming sight for an aimed device, comprising:

a) obtaining a light conductive member having a length disposed between a member first end and member second end, said light conductive member having an external surface configured to receive light along said length and conduct said light to at least said member first end to provide a viewable aiming indicia, said light conductive member having a retention recess disposed in said external surface at a location between said first member end and said second member end;

b) obtaining a sight body adapted to mount on said aimed device, said sight body having a bore which defines passage which communicates between a base first end and a base second end, said bore having a bore retention member which projects into said passage, said bore having a bore recess disposed in opposed relation to said retention member;

c) inserting said light conductive member inside of said passage communicating between said base first end and said base second end of said sight body;

d) slidely engaging said retention member projecting into said passage with said external surface of said light conductive member;

e) sufficiently flexing said light conductive member into said bore recess in response to sliding engagement of said retention member over said external surface; and f) matedly engaging said retention member of said bore in said retention recess of said light conductive member, thereby retaining said light conductive member unflexed within said sight body.

18. The method of claim 17, wherein said light conductive member has a cylindrical configuration and wherein said retention recess comprises an annular groove.

19. The method of claim 18, wherein said light conductive member proximate said member second end has a configuration of a hemisphere.

20. The method of claim 19, wherein said external surface of said light conducting member has a member first portion proximate said member first end and a member second portion extending from said member first portion to said member second end, said first member portion having a greater diameter than said member second portion, said member first portion co-axially joined to said second member portion by a truncated cone, and wherein said bore has a bore first portion proximate said body first end and a bore second portion extending from said bore first portion to said body second end, said bore first portion having a greater diameter than said bore second portion, said bore first portion co-axially joined to said bore second portion by a bore annular ring, and further comprising receiving within said bore first portion said member first portion, said external surface of said truncated cone having abutted engagement with said bore annular ring.

21. The method of claim 17, further comprising:

a) sufficiently flexing said light conductive member proximate said member second end into said bore recess of said bore to disengage said retention member from said retention recess;

b) sliding said retention member over said external surface of said light conductive member toward said member second end to disengage said retention member from said external surface of said light conductive member;

c) unflexing said light conductive member;

d) sliding said member second end toward said base first end; and e) removing said light conductive member from said sight body.

* * * * *